United States Patent [19]

Pearce

[11] 3,937,426

[45] Feb. 10, 1976

[54] TETRAHEDRAL KITE STRUCTURE

[75] Inventor: Peter J. Pearce, Studio City, Calif.

[73] Assignee: Synestructics, Inc., Chatsworth, Calif.

[22] Filed: Nov. 9, 1973

[21] Appl. No.: 414,531

[52] U.S. Cl. ..... 244/153 R
[51] Int. Cl.[2] ..... B64C 31/06
[58] Field of Search ..... 244/153–155; 403/176; D34/15 AF

[56] References Cited

UNITED STATES PATENTS

| | | | |
|---|---|---|---|
| 770,626 | 9/1904 | Bell | 244/153 R |
| 2,451,571 | 10/1948 | Marshall | 244/155 A |
| 2,744,701 | 5/1956 | Robey | 244/153 R |
| 2,769,605 | 11/1956 | Sparkman | 244/153 R |
| 3,120,367 | 2/1964 | Rice | 244/153 R |
| 3,317,165 | 5/1967 | Zobl | 244/155 R |
| 3,494,578 | 2/1970 | Cureton | 244/153 R |
| 3,599,909 | 8/1971 | Young | 244/153 R |
| 3,600,825 | 8/1971 | Pearce | 403/176 UX |

*Primary Examiner*—Trygve M. Blix
*Assistant Examiner*—Galen L. Barefoot
*Attorney, Agent, or Firm*—Marvin H. Kleinberg

[57] ABSTRACT

A tetrahedral kite having a sail formed by a pair of sheets of rhombus shape that lie facewise against one another and are joined together along their edges. The middle of the rhombus-shaped sail is folded about an edge of the tetrahedral kite frame so that the sail portions one either side of the middle line cover one surface of the tetrahedron, the edges of the sail being held by struts of the kite frame that lie sandwiched between the two sheets of the sail along the edges thereof.

13 Claims, 10 Drawing Figures

TETRAHEDRAL KITE STRUCTURE

BACKGROUND OF THE INVENTION

This invention relates to kites.

One type of kite which flies in a stable manner and which utilizes a frame of minimum weight and complexity is a kite of largely triangular shape, and particularly one which has a tetrahedral shape. The advantages of kites of tetrahedral shape, including those containing four or sixteen tetrahedral sails arranged to form large tetrahedral-shaped structures, were related by Alexander Graham Bell at the beginning of this century. While such kites have many theoretical advantages, their widespread use depends upon the provision of kites of such shape which can be manufactured at low cost and easily assembled by the user.

SUMMARY OF THE INVENTION

In accordance with one embodiment of the present invention, a tetrahedral kite is provided whose components can be manufactured at low cost and which can be assembled with a minimum of effort into a kite that flies easily and stably. The kite includes a frame having struts arranged along the edges of a tetrahedral geometric figure and held together by connectors positioned at the four apexes of the figure. Two surfaces of the tetrahedral figure are covered by a sail which is originally of a diamondlike rhombus shape. The middle line of the sail is folded around one of the struts so that sail portions on either side of the middle cover a different face of the geometric figure. The sail is formed by two sheets of thin plastic positioned facewise against each other and joined together along the four edges of the sheets. The sail is mounted on the frame by inserting four struts of the frame between the sheets, so that each of these struts lies against an edge of the sail but sandwiched between the sheets thereof. The struts have a non-square rectangular cross-section and are held by connectors of corresponding rectangular arms that minimize the possibility of improper assembly. The tetrahedral kite structures are normally assembled into a kite containing four or sixteen identical tetrahedral structures.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
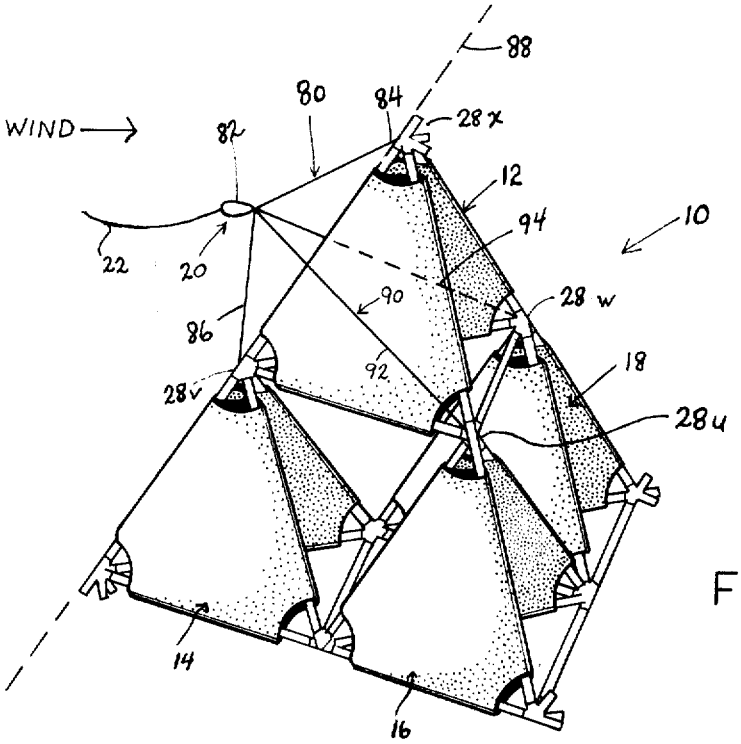
FIG. 1 is a perspective view of a four-cell tetrahedral kite's structure constructed in accordance with one embodiment of the invention.
Figure 9:
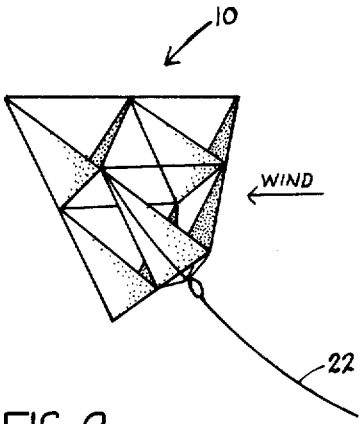
FIG. 9 is a perspective view showing the manner in which the kite of FIG. 1 is flown.

FIG. 1 illustrates a tetrahedral kite 10 which is formed by four tetrahedral structures or cells. The kite 10 can be launched from the ground by means of a bridle 20 which includes a flying string 22 that is pulled towards the incoming direction of the wind. Once the kite is airborne it will fly in the orientation shown in FIG. 9, in a stable manner and without a kite tail.

Figure 2:
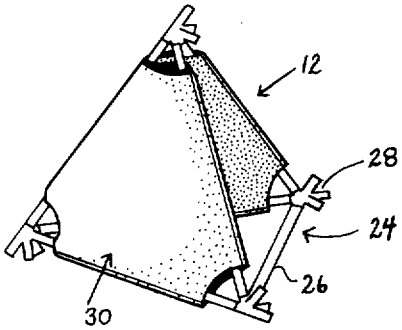
FIG. 2 is a perspective view of a single-cell tetrahedral kite, which also forms one cell of the structure of FIG. 1.

FIG. 2 illustrates one kite section or cell 12 of the kite of FIG. 1, the structure 12 being capable of flying as a kite by itself, although the stability is generally not as good as a multi-cell kite of the type shown in FIG. 1. The single cell kite 12 includes a frame 24 composed of six elongated members or struts 26 arranged along the edges of a tetrahedral geometric figure and joined together by four connectors 28 that are positioned at the apexes of the tetrahedral figure. The kite also includes a sail 30 that covers two sides or surfaces of the tetrahedral figure. The sail 30 is formed of a double thickness of plastic which is wrapped about two faces of the geometric figure, which enables low cost production of the sail and ease in mounting it on the frame of the kite.

Figure 3:
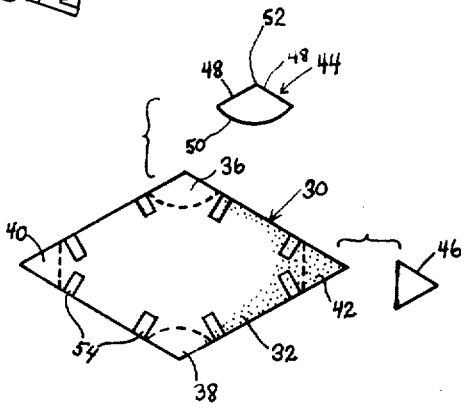
FIG. 3 is a plan view of the sail of the kite of FIG. 2, and showing the shape of cutout patterns useful therewith.
Figure 6:
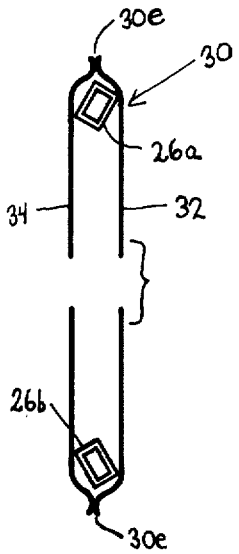
FIG. 6 is a view taken on the line 6—6 of FIG. 5.

A better understanding of the kite can be gained by considering the manner in which the kite is assembled from a kit. A kit portion for producing the single cell kite 12, includes one sail 30, six struts 26, and four connectors 28. Actually, four of such kit portions are generally provided in order to construct the four cell kite of FIG. 1. FIG. 3 illustrates the shape of the sail 30 when it is laid out flat. The sail includes two sheets 32, 24 (FIG. 6) of thin plastic material such as polyethylene, which are joined together along their edges 30e. The sail and the two sheets 32, 24 thereof are in the form of a diamond-shape rhombus.

The sail 30 may be supplied in the form illustrated in FIG. 3, in which case it is necessary to trim the sail by forming cutouts at the corners 36, 38, 40 and 42. Two patterns 44, 46 are provided in the kit to facilitate the making of the cutouts. One pattern 44 has straight sides 48 extending at an angle of 120°, to match the intersection angle at one corner of the sail. This pattern 44 is curved along another side 50 about an axis point 52 which lies at the intersection of the sail sides. The other pattern 46 is of simple triangular shape. The pattern 44 is utilized at the two areas 36, 38 which lie at the top and bottom of the center portion of the sail 30. In order to minimize tearing of the sail, strips of adhesive tape 54 may be applied by the kite user near the cutout areas of the sail.

Figure 4:
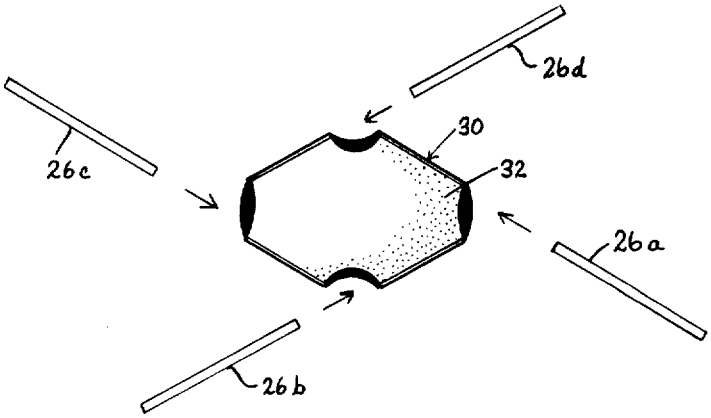
FIG. 4 is a plan assembly view showing how the struts are installed in the sail of FIG. 3 after cutouts have been formed in the sail.

After the cutouts have been formed, four struts **26*a*, 26*b*, 26*c*, and 26*d* are installed in the manner shown in FIG. 4. Each strut is inserted between the sheets 32, 34** of the sail, so that the strut lies against an edge of the sail where the two sheets thereof are joined together. After insertion, the struts are positioned in the manner illustrated in FIGS. 5 and 6.

Figure 5:
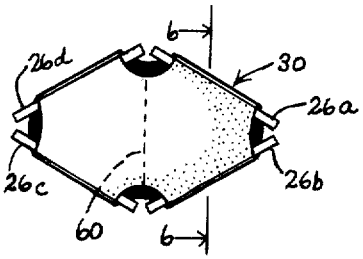
FIG. 5 is a plan view of the structure of FIG. 4 after the struts have been installed.
Figure 7:
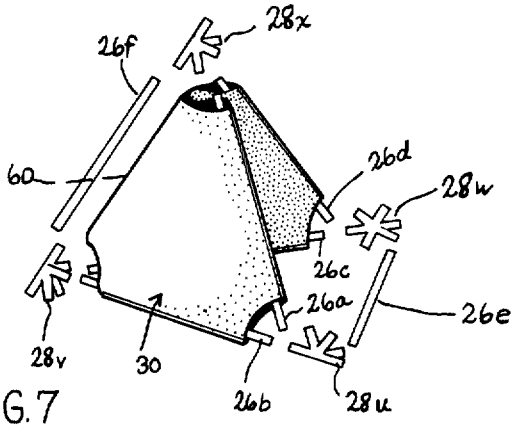
FIG. 7 is an exploded perspective view of the kite of FIG. 2, showing a final stage in the assembly thereof.

The sail and strut assembly of FIG. 5 is next bent or folded along the center line 60 of the sail to the configuration illustrated in FIG. 7. The four connectors **28*u***, 28*v*, 28*w* and 28*x* then may be installed between the two connectors 28*u* and 28*w*, while a second additional strut 26*f* is installed in extension between the connectors 28*v*, 28*x*. The strut 26*f* is positioned behind the middle or fold line 60 of the sail, within the fold of both sheets 32, 34 of the sail (i.e., not sandwiched between the sheets). Accordingly, the strut 26*f* will contact only the innermost sheet 32 of the double-walled sail and will not contact the other sheet 34 thereof.

The use of a double-walled sail and particularly one which is wrapped about one edge of the tetrahedral figure to cover two surfaces thereof, enables low cost production and assures good strength with a minimum of weight and complexity. Sails of the form shown in FIG. 3 can be easily produced from a double-walled roll of material which is heat sealed along opposite edges thereof, by merely cutting the roll with a heated die that seals the sheets together at the cut. Suitable rolls of double walled material are commercially available as rolls of flattened integral or heat sealed tubing. The attachment of the edges of the sail to the struts of the frame is accomplished in a simple manner, and with the stresses in the sail evenly distributed along the length of the struts. Attachment to only four struts is required because of the fact that the middle of the sail is folded around one edge of the tetrahedral frame.

Figure 8:
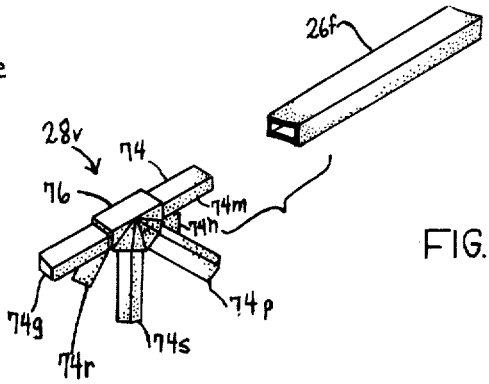
FIG. 8 is a partial perspective view showing a connector and strut of the structure of FIG. 7.

In order to assure proper assembly of the kite, the struts 26 are formed with a non-square rectangular cross-section and the arms or spokes 74 of each connector 28 are correspondingly formed. As illustrated in FIG. 8, each strut is of hollow rectangular construction, the rectangular cross-section being non-square. The struts are of a resilient material and the sides of the rectangle are curved inward to assure a tight fit. Each connector such as 28*v* has six elongated spokes 74 of rectangular cross-section radiating from a central portion 76, each spoke being receivable in the end of a strut such as 26*f*. Actually, only three spokes 74*m*, 74*n*, 74*p* are required to join the three strut ends at an apex of a tetrahedron, but three additional spokes 74*q*, 74*r*, 74*s* are provided in order to enable the same connector to be used to hold to the struts of another adjacent tetrahedron when constructing a multi-cell kite such as that shown in FIG. 1.

When a person assembles the kite frame 24, it is possible that he will try to use the wrong spokes of a connector to hold together the struts of one tetrahedron cell. He should use either the set of spokes 74*m*, 74*n*, 74*p* which are at an angle of 60° from one another, or the set 74*q*, 74*r*, 74*s* which are similarly at 60° from one another. The use of non-square rectangular connector spokes and struts minimizes the chance of confusion because it eliminates the number of possible orientations of the connector after it has been attached to one strut. If, instead, the struts and connector spokes were of round or square cross-section, then a person would install the spoke 74*p* into strut 26*f* without quickly becoming aware of his mistake. With spoke 74*p* installed in strut 26*f*, it might appear that the other two spokes of the set are 74*n* and 74*s*, even though the angle between 74*n* and 74*s* is 90° instead of 60° (i.e. one spoke is only 30° out of alignment). This could lead to damage if a person attempts to bend a strut to enter connector spoke.

Instead of utilizing a round or square cross-section, the connector of the present invention utilizes an elongated, or non-square retangular cross-section to prevent the type of mistake described above. With the non-square rectangular cross-section, installation of spoke 74*p* into strut 26*f* can be accomplished only by a connector orientation which clearly indicates that there is a mistake. In such an orientation resulting from rectangular spoke 74*p* being installed in strut 26*f*, it is clear that one strut of the tetrahedron cannot be received into any of the spokes because the spokes closest to alignment with it (74*m* and 74*q*) are 90° out of alignment from the required spoke orientation (instead of only 30°). Thus, the invention allows the use of identical struts and connectors throughout the kite, with minimal confusion in assembly of the kite. Of course, it is also possible to utilize another cross-sectional shape so long as it requires more than a 90° rotation to bring the cross-sectional shape into coincidence with its pattern prior to the rotation. A circular cross-section is brought into coincidence after any rotation while a square is brought into coincidence after 90°, so that neither of these should be used. A non-square rectangle requires a 180° rotation so it can be used. A shape such as a non-square parallelogram which has symmetry after rotation of 180° and only after rotation of 180° is preferred, inasmuch as it allows the use of a single connector type throughout the kite while minimizing confusion in assembly. Such later symmetry may be referred to as two-fold symmetry, and is obtained by other shapes such as I beam shape. A shape with only mirror symmetry, but no rotational symmetry (e.g. requires 360° rotation to come into coincidence), such as an isosceles triangle which is not equilateral, or a trapezoid, can also be utilized to permit a single connector type to be utilized throughout the kite while minimizing confusion in assembly.

A four cell tetrahedron kite of the type illustrated in FIG. 1, may be constructed by first constructing the single cell kite of FIG. 2 and then adding additional cells onto it. Before the kite can be flown, however, it is also necessary to attach the bridle 20. The bridle 20 is constructed using three strings. As shown in FIG. 1, a first of the strings 80 is formed with a loop 82 at its center and with opposite ends 84, 86 tied to connectors 28*x*, 28*v* that lie along a common imaginary line 88 about which the sails of two kite 12, 14 are folded, the imaginary line 88 being a common edge of the two sail-covered surfaces of the kite 12 and of the two sail-covered surfaces of the kite 14. A second harness string 90 extends through the loop 82 of the first string and has opposite ends 92, 94 tied to connectors 28*u*, 28*w* that lie opposite the fold line 88. The length of the second string 90 is chosen so that when the loop 82 is pulled and the first string 80 is taut, the second string 90 also becomes taut. The flying string 22 has one end tied to the loop 82 and has another end held by the person flying the kite, the flying string typically being extremely long to enable the kite to be flown at a high altitude.

Figure 10:
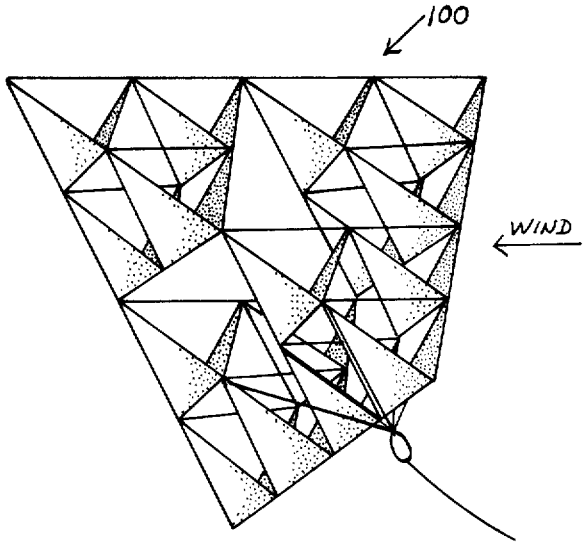
FIG. 10 is a perspective view showing the manner in which a sixteen cell tetrahedral kite of the invention is flown.

The kite of FIG. 1 may be launched by positioning it on the ground in the manner shown in FIG. 1 and pulling the flying string 22 into the wind. After the kite becomes airborne, it normally flies in the orientation shown in FIG. 9. The kite structure can be built up into a sixteen cell kite of tetrahedral shape, which is shown at 100 in FIG. 10, this figure showing the orientation of the kite in normal flight.

Thus, the invention provides a kite structure of high strength to weight ratio, and which can be manufactured at low cost and readily assembled by a user. The invention provides a kite of tetrahedral design which utilizes a sail constructed of two sheets disposed facewise against one another and joined together around their edges. This facilitates attachment to the framework of the kite without the need for separate fasteners and the like, inasmuch as it permits struts of the framework to be attached by merely inserting the struts between the sheets so they lie against the edges of the joined sheets. The sail may be constructed in a substantially diamond shape, and it is utilized to cover two sides or faces of the tetrahedral geometric figure by folding the middle of the sail about one edge of the framework. The framework may be constructed of a number of identical struts and identical connectors, with minimal confusion, by utilizing non-square rectangular struts and corresponding connectors. Of course, solid struts can be used that fit into hollow connector spokes or sockets instead of the reverse construction which has been illustrated herein. A simple bridle arrangement is provided which utilizes three strings. One harness string has a loop at its middle while the second harness string extends largely perpendicular to the first one and through the loop. A flying string which extends to a person at the ground is connected to the loop of the first harness string. This arrangement is simple to construct and it provides a good distribution of forces to the frame of the kite while also tending to keep the kite flying in a stable manner.

Although particular embodiments of the invention have been described and illustrated herein, it is recognized that modifications and variations may readily occur to those skilled in the art and consequently, it is intended that the claims be interpreted to cover such modifications and equivalents.

I claim:

1. A tetrahedral kite comprising:

a frame having struts of a rigid material arranged along the edges of a tetrahedral geometric figure; and a sail covering a pair of surfaces of said tetrahedral figure;

said sail having a substantially diamond shape, having four edges, with a middle portion folded about one of said struts and having first and second sail portions integral with the middle portion and lying on either side of said middle portion and over said pair of surfaces of the tetrahedral figure, said sail including two sheets positioned facewise against each other, substantially in contact over their entire surface and joined together along their edges, one of said struts extending between the sheets along an edge where the sheets are joined together.

2. The tetrahedral kite described in claim 1 wherein:

said frame includes four corner connectors joining the ends of said struts together; and said diamond-shaped sheet has four edges respectively held to different struts, and said sheet has cut-outs at its four corners for preventing interference with the connectors.

3. The tetrahedral kite described in claim 2 wherein:

the cut-outs at the top and bottom of the middle portion are curved substantially about an axis lying at an imaginary intersection of adjacent edges of the sheet.

4. The tetrahedral kite described in claim 1 wherein:

said kite defines a four-cell tetrahedron, and includes struts arranged along the edges of second, third and fourth additional tetrahedral geometric figures to form second, third and fourth frames, respectively, said first named, second, third and fourth frames held together in a four-cell tetrahedron framework in which each of the frames lies adjacent to a different apex of the four-cell tetrahedron framework;

each of said four frames having a substantially diamond-shaped sail lying over a pair of surfaces thereof and having a middle portion folded around one of the struts thereof.

5. A kit for constructing a tetrahedral kite comprising:

six struts of a rigid material and of equal length;

four connectors, each constructed to hold the ends of three struts together so the struts radiate from the apex of a tetrahedral geometric figure; and a substantially rhombus-shaped sail, having four edges, said sail including two sheets positioned facewise against each other, substantially in contact over their entire surfaces and joined together along their edges, with each edge of the sail having a length approximately as great as the length of each strut, so that the middle of the sail can be folded about one edge of said tetrahedral figure to allow the sail to cover two surfaces of said figure, whereby an edge of said sail can be held to a strut merely by projecting the strut between the sheets so that the strut lies immediately inside an edge of said sail.

6. The kit described in claim 5 including:

at least one cut-out pattern for indicating the shape of a cutout to be made at either end of the folded-over portion of the sail, said pattern including means defining straight lines extending at an angle of more than 90° from each other for lying along a pair of edges of the sheet and a curved line joining the straight lines for indicating the line along which the sail is to be cut.

7. In a tetrahedral kite which includes four tetrahedral kite sections, each kite section having a sail covering a pair of surfaces thereof which have a common edge, and with the common edges of first and second kite sections lying on a common imaginary line, the improvement of a bridle for said kite comprising:

a first harness string with a loop formed at the middle thereof, said loop lying in front of said common imaginary line, and the ends of said first string tied to spaced portions of the kite;

a second harness string with a middle portion extending through said loop in said first string and extending substantially perpendicular to said first string, said second string having end portions tied to spaced portions of the kite, said second string being of a length that results in it being pulled taut when the first string is pulled taut by forces applied at the loop thereof; and a flying string attached to said loop of said first string.

8. The improvement described in claim 7 wherein:

one of said harness strings has opposite ends tied to the two apexes of said first kite section which lie on said common imaginary line, and the other harness string has opposite ends tied to the other two apexes of said first kite section.

9. A tetrahedral kite comprising:

a frame having struts of a rigid material arranged along the edges of a substantially tetrahedral geometric figure;

a sail extending along first and second surfaces of the tetrahedral figure;

said sail including a pair of sheets substantially in contact over their entire opposing surfaces and joined together along their edges, a plurality of said struts extending between the sheets along the edges of the sail, said sail extending in a fold about one of said struts which forms an edge that is common to both said first and second surfaces, with said strut lying within the fold of both sheets of the sail and against the innermost sheet at the fold, said sail, when laid flat, forms a four-sided figure;

a first harness string with a loop formed at the middle thereof, said loop lying in front of said common imaginary line, and the ends of said first string tied to spaced portions of the kite;

a second harness string with a middle portion extending through said loop in said first string and extending substantially perpendicular to said first string, said second string having end portions tied to spaced portions of the kite, said second string being of a length that results in it being pulled taut when the first string is pulled taut by forces applied at the loop thereof; and a flying string attached to said loop of said first string.

10. A tetrahedral kite comprising:

a frame having struts of a rigid material arranged along the edges of a substantially tetrahedral geometric figure;

a sail extending along first and second surfaces of the tetrahedral figure;

said sail including a pair of sheets substantially in contact over their entire opposing surfaces and joined together along their edges, a plurality of said struts extending between the sheets along the edges of the sail, said sail extending in a fold about one of said struts which forms an edge that is common to both said first and second surfaces, with said strut lying within the fold of both sheets of the sail and against the innermost sheet at the fold, said sail, when laid flat, forms a four-sided figure with four corner portions; and, connectors for holding said struts together in a framework, each connector including a center portion and a plurality of elongated spoke means radiating from the center portion for engaging the ends of said struts, a first set of three spoke means angled at 60° from one another and a second set of three spoke means angled at 60° from one another, all of said spoke means having the same predetermined cross-sectional shape which can be brought into coincidence with itself after rotation, only by a rotation of more than 90°, whereby to minimize the number of possible orientations of a connector on a strut end and thereby facilitate assembly of the kite.

11. The kite of claim 10 wherein each of the corner portions is cut away to leave an opening through which the ends of two struts extend, said cutaway portions being curved substantially about an axis lying at the imaginary intersection of adjacent edges of said sail.

12. A kit for constructing a tetrahedral kite comprising:

six struts of a rigid material and of equal length;

four connectors, each constructed to hold the ends of three struts together so the struts radiate from the apex of a tetrahedral geometric figure, each connector including a center portion and a plurality of elongated spoke means radiating from the center portion for engaging the ends of said struts, a first set of three spoked means angled at 60° from one another and a second set of three spoke means angled at 60° from one another, all of said spoke means having the same predetermined cross-sectional shape which can be brought into coincidence with itself after rotation, only by a rotation of more than 90°, whereby to minimize the number of possible orientations of a connector on a strut end and thereby facilitate assembly of the kite; and a substantially rhombus-shaped sail, having four edges, said sail including two sheets positioned face-wise against each other substantially in contact over their entire opposing surfaces and joined together along their edges, with each edge of said sail having a length approximately as great as the length of each strut so that the middle of the sail can be folded around one edge of said tetrahedral figure to allow said sail to cover two surfaces of said figure, whereby an edge of said sail can be held to a strut merely by projecting the strut between the sheets so the strut lies immediately inside an edge of said sail.

13. The kit of claim 12 wherein each of the corner portions is cut away to leave an opening through which the ends of two struts extend, said cutaway portions being curved substantially about an axis lying at the imaginary intersection of adjacent edges of said sail.

* * * * *